US010826188B2

(12) United States Patent
Kristou et al.

(10) Patent No.: US 10,826,188 B2
(45) Date of Patent: Nov. 3, 2020

(54) ELECTROMAGNETICALLY REFLECTIVE PLATE WITH A METAMATERIAL STRUCTURE AND MINIATURE ANTENNA DEVICE INCLUDING SUCH A PLATE

(71) Applicant: Commissariat a l'energie atomique et aux energies alternatives, Paris (FR)

(72) Inventors: Nebil Kristou, Fontaine (FR); Jean-Francois Pintos, Saint-Blaise-du-Buis (FR)

(73) Assignee: Commissariat a l'energie atomique et aux energies alternatives, Paris (FR)

( * ) Notice: Subject to any disclaimer, the term of this patent is extended or adjusted under 35 U.S.C. 154(b) by 84 days.

(21) Appl. No.: 16/074,571

(22) PCT Filed: Feb. 16, 2017

(86) PCT No.: PCT/FR2017/050349
§ 371 (c)(1),
(2) Date: Aug. 1, 2018

(87) PCT Pub. No.: WO2017/140987
PCT Pub. Date: Aug. 24, 2017

(65) Prior Publication Data

US 2019/0044244 A1 Feb. 7, 2019

(30) Foreign Application Priority Data

Feb. 17, 2016 (FR) ..... 16 51278
Feb. 19, 2016 (FR) ..... 16 51373

(51) Int. Cl.
*H01Q 15/00* (2006.01)
*H01P 1/20* (2006.01)
*H01Q 15/14* (2006.01)

(52) U.S. Cl.
CPC ..... *H01Q 15/008* (2013.01); *H01P 1/2005* (2013.01); *H01Q 15/0066* (2013.01); *H01Q 15/14* (2013.01); *H01Q 15/006* (2013.01)

(58) Field of Classification Search
CPC ..... H01Q 15/008; H01Q 15/006; H01Q 15/0066; H01Q 15/14; H01P 1/2005
See application file for complete search history.

(56) References Cited

U.S. PATENT DOCUMENTS 8,354,975 B2 * 1/2013 Ando ..... H01Q 9/0421 333/202
2003/0142036 A1 * 7/2003 Wilhelm ..... H01Q 1/36 343/909

(Continued)

OTHER PUBLICATIONS

Daniel Frederic Sievenpiper, "High-Impedance Electromagnetic Surfaces," PhD from the University of California, Los Angeles (USA), 1999, 161 pages.

(Continued)

*Primary Examiner* — Robert Karacsony
(74) *Attorney, Agent, or Firm* — Oblon, McClelland, Maier & Neustadt, L.L.P.

(57) ABSTRACT

An electromagnetically reflective plate for a miniature antenna device includes: etched conductive elements on a first dielectric substrate layer; an apertured ground plane placed between the first substrate layer and a second dielectric substrate layer; a set of metal through-vias formed in the thickness of the two substrate layers, each including an upper end making contact with one of the conductive elements, a lower end reaching a lower face of the second substrate layer, and passing through the ground plane without electrical contact in one of its apertures. Each conductive element makes contact with a plurality of vias and each via of each conductive element is connectable to another via of a neighboring conductive element using a corresponding (Continued)

Figure 1:
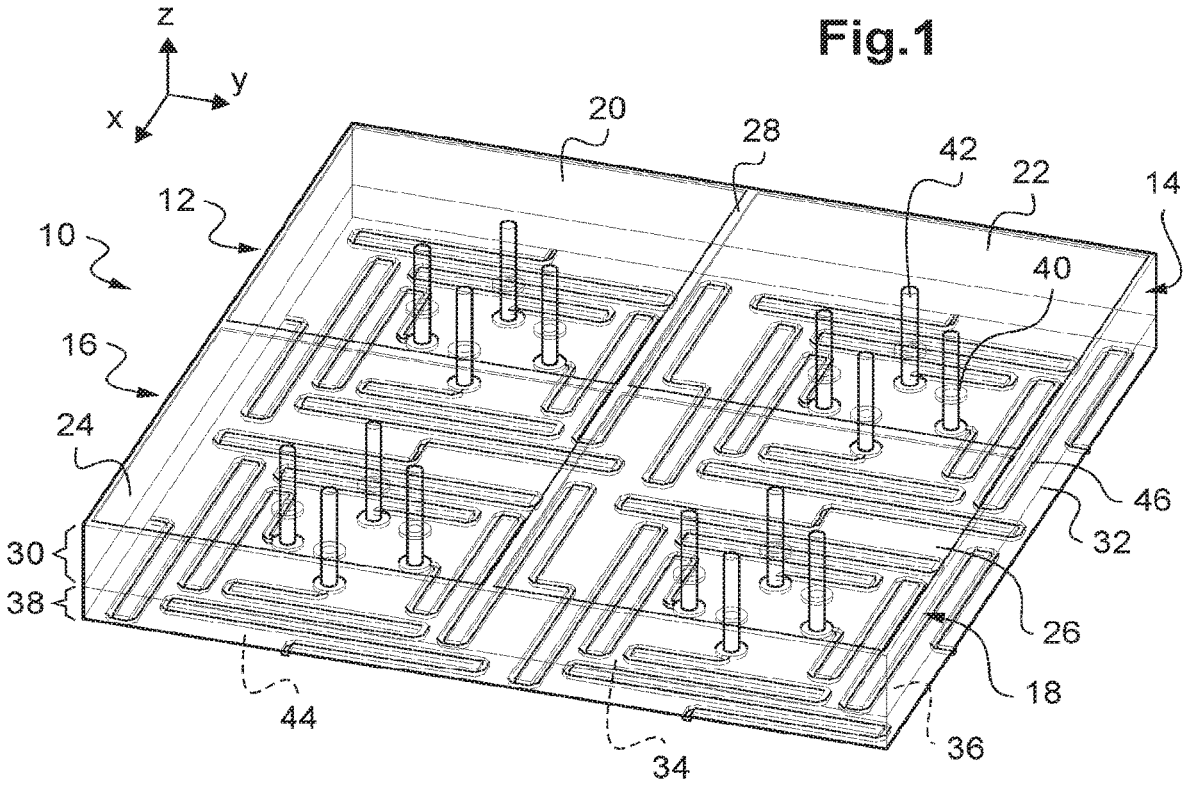

electrical connection making contact with the lower end of this via. At least some of the electrical connections include one or more meanders.

11 Claims, 3 Drawing Sheets

(56) References Cited

U.S. PATENT DOCUMENTS

| | | | | |
|---|---|---|---|---|
| 2009/0236141 | A1 | 9/2009 | Kim et al. | |
| 2010/0127943 | A1 | 5/2010 | Inoue et al. | |
| 2010/0252319 | A1 | 10/2010 | Cho et al. | |
| 2011/0061925 | A1* | 3/2011 | Kim | H05K 1/0233 174/377 |
| 2012/0007786 | A1* | 1/2012 | Ando | H01Q 9/0407 343/749 |
| 2012/0234591 | A1 | 9/2012 | Kim et al. | |
| 2014/0354502 | A1 | 12/2014 | Pintos et al. | |

OTHER PUBLICATIONS

International Search Report dated Jun. 2, 2017 in PCT/FR2017/050349 filed Feb. 16, 2017.

* cited by examiner

Fig.2B
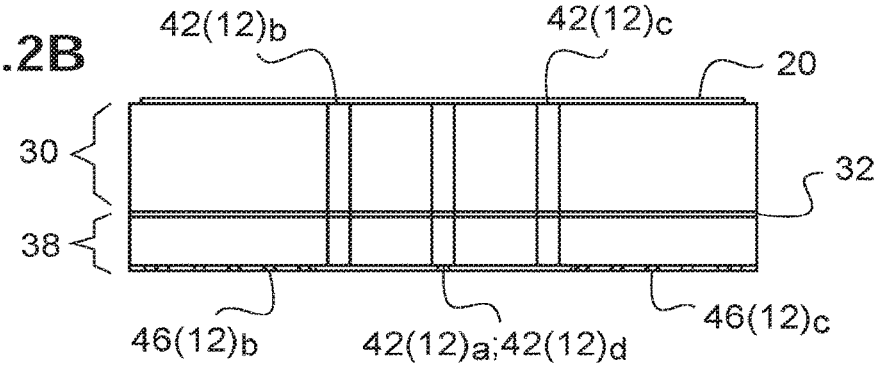
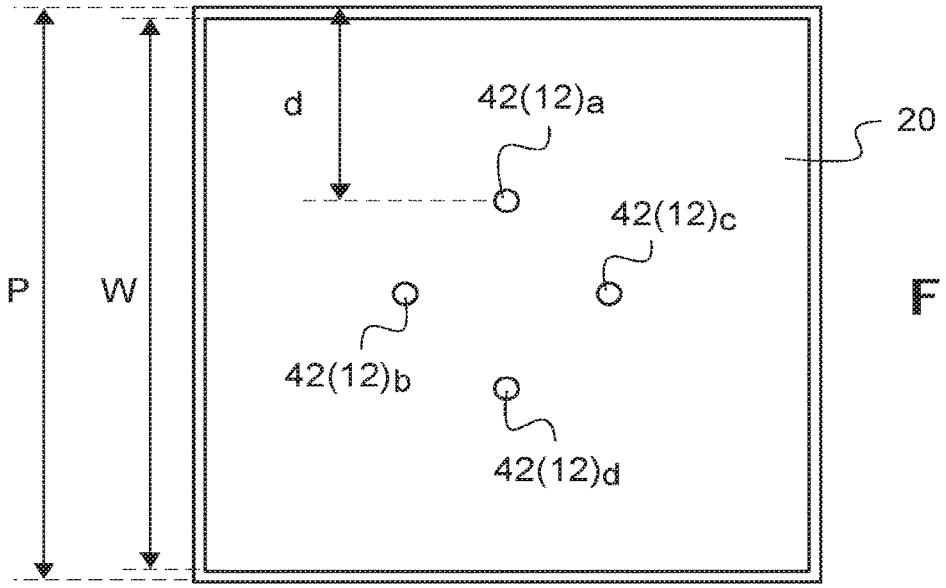
Fig.2C
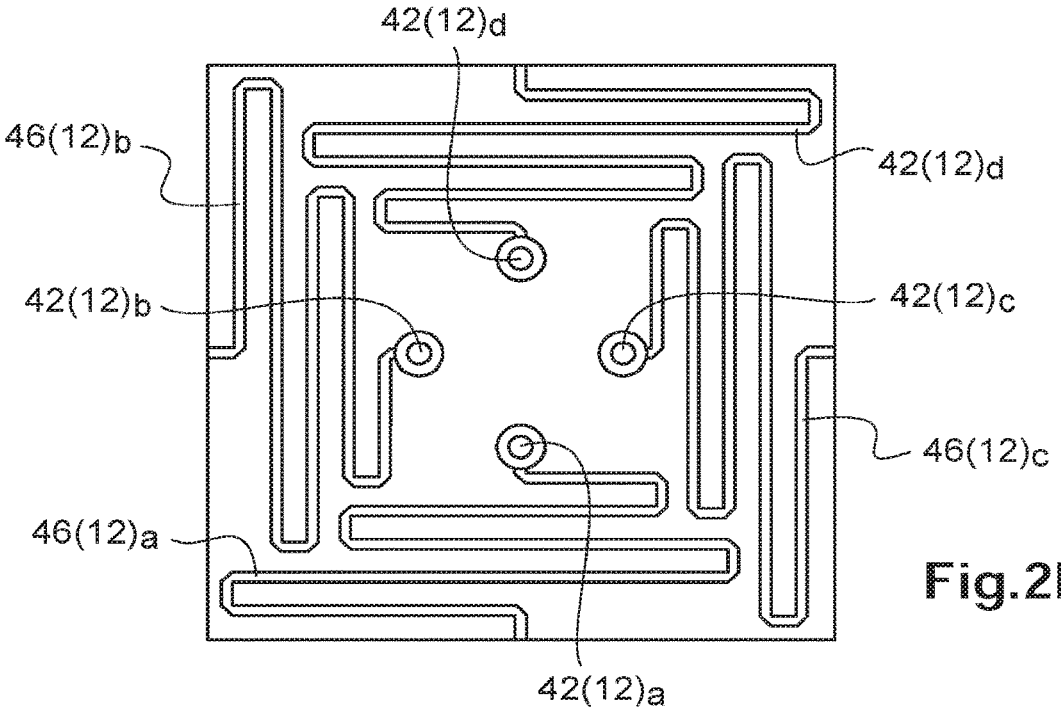
Fig.2D

ELECTROMAGNETICALLY REFLECTIVE PLATE WITH A METAMATERIAL STRUCTURE AND MINIATURE ANTENNA DEVICE INCLUDING SUCH A PLATE

The present invention relates to an electromagnetically reflective plate with a metamaterial structure for a miniature antenna device. It also relates to a miniature antenna device including such an electromagnetically reflective plate and an antenna placed at a short distance from this plate.

Generally, it falls under applications for telecommunication systems or communicating objects wherein radiofrequency devices, including antennas and electronic circuits, are present and must be as least voluminous as possible. In particular, the use of antennas in communication systems for aerospace, surveillance or satellite navigation is vital. However, in these types of devices, space is reduced and generates a need to miniaturize antennas. An antenna is generally placed here in front of a reflective plane to have a one-way beam and to enable the integration of an electronic circuit close behind the reflective plane without substantial interference. The beam is thus directed in a direction of interest, enabling, on the one hand, to improve the gain of the antenna and, on the other hand, to reduce the sensitivity of the antenna in a half-space.

According to a first embodiment technology possible for the reflective plane, the latter is of a type close to the perfect electrical conductor model, with reflection of the electromagnetic field in opposite phase. The antenna must thus be placed at a distance from the reflective plane, as close as possible to a quarter of the average functioning wavelength thereof to compensate for the opposite phase shift in reflection and to obtain a constructive interference between an incident wave coming directly from the antenna and a wave reflected by the reflective plane. With metric and decametric wavelengths, this technology has the disadvantage of being voluminous. For example, for an average functioning frequency $f_0$=100 MHz of the antenna, it should be placed 75 cm from the reflective plane and for $f_0$=1 GHz, this still represents a distance of 7.5 cm.

According to a second possible embodiment technology of the reflective plane, the latter is of the artificial magnetic conductor type, close to the perfect magnetic conductor model, with reflection of the electromagnetic field without dephasing. The antenna can thus be placed very close to the reflective plane, in particular far less than a quarter of the average functioning wavelength thereof, even less than one tenth of this wavelength. This considerably reduces the volume of the antenna device and enables the advantageous integration thereof in the design of miniature antennas. A reflective plane according to this technology can be made using an electromagnetically reflective plate with a metamaterial structure which precisely forms the subject matter of the present invention. A method has moreover been proposed in 1999 in the PhD thesis document by Sievenpiper, entitled, "High-impedance electromagnetic surfaces", PhD from the University of California, Los Angeles (USA), to characterize artificial magnetic conductors by a method referred to as phase diagram. This method consists of illuminating the surface to be characterized using a plane wave and under a normal incidence. Then, the phase difference that exists between the incident wave and the reflected wave is compared. The interferences are considered as constructive when the phase difference is between $-\pi/2$ and $+\pi/2$, which thus defines the bandwidth for using the artificial magnetic conductor.

According to this second artificial magnetic conductor technology, the present invention relates more specifically to an electromagnetically reflective plate with a metamaterial structure for a miniature antenna device, including:

- a plurality of conductive elements separated from each other and etched on an upper face of a dielectric substrate layer,
- a ground plane placed on the lower face of this dielectric substrate layer, and
- a set of metal through-vias formed in the thickness of the substrate, each one including an upper end making contact with one of the conductive elements.

However, the miniaturization of such an electromagnetically reflective plate is limited by the minimum number of conductive elements necessary to obtain a metamaterial structure, often organized into a matrix of at least four lines and four columns. Indeed, each one of these resonating conductive elements is generally of dimensions close to a quarter of the average functioning wavelength of the antenna. Consequently, a metamaterial structure very quickly involves a significantly reflective surface opposite the antenna to guarantee the functioning thereof in the frequency range of interest of the antenna.

Different solutions have been provided to improve the miniaturization of metamaterial structures, in particular by playing on the geometry of the conductive elements (interdigital capacities, spiral inductances, etc.), on a multiplication of capacity-coupled layers or by using discrete, passive or active electronic components. But, all these solutions have disadvantages of cost, substantial reduction of the bandwidth of the antenna or the thickness volume.

In a use of metamaterial structures different from that considered in the present invention, that of inter-antenna filtering components with electromagnetic band-gap (referred to as EBG components), innovative approaches have been proposed.

For example, in patent application US 2014/0354502 A1, an apertured ground plane is proposed, through which metal vias pass, these not making contact with the ground plane, but connected to each other, two-by-two, using dedicated electrical connections, situated on the other side of the ground plane with respect to the conductive elements.

For example too, in patent application US 2009/0236141 A1, in FIG. 8, a metamaterial structure is proposed, for EBG filtering, including:

- a plurality of conductive elements separated from each other and etched on an upper face of a first dielectric substrate layer,
- a ground plane placed between a lower face of the first dielectric substrate layer and an upper face of a second dielectric substrate layer, with apertures arranged in this ground plane,
- a set of metal through-vias formed in the thickness of the first and second substrate layers, each one including an upper end making contact with one of the conductive elements, a lower end reaching a lower face of the second dielectric substrate layer, and passing through the ground plane without electrical contact in one of its apertures, wherein:

- each conductive element makes contact with a plurality of metal vias, and
- each metal via of each conductive element is connectable to another metal via of a neighboring conductive element, using a corresponding electrical connection making contact with the lower end of this metal via.

But, in these two last documents, the reflective properties of the structure obtained are not observed, only the uncoupling between neighboring antennas and the filtering of interference signals being studied. Furthermore, such a structure does not appear sufficient to obtain an additional miniaturization in the case of an electromagnetically reflective application.

It can thus be desired to design an electromagnetically reflective plate with a metamaterial structure for a miniature antenna device which enables an additional miniaturization, while avoiding at least some of the above-mentioned problems and limitations.

An electromagnetically reflective plate with a metamaterial structure for a miniature antenna is therefore proposed, including:

- a plurality of conductive elements separated from each other and etched on an upper face of a first dielectric substrate layer,
- a ground plane placed between a lower face of the first dielectric substrate layer and an upper face of a second dielectric substrate layer, with apertures arranged in this ground plane,
- a set of metal through-vias formed in the thickness of the first and second substrate layers, each one including an upper end making contact with one of the conductive elements, a lower end reaching a lower face of the second dielectric substrate layer, and passing through the ground plane without electrical contact in one of its apertures, wherein:

- each conductive element makes contact with a plurality of metal vias, and
- each metal via of each conductive element is connectable to another metal via of a neighboring conductive element, using a corresponding electrical connection making contact with the lower end of this metal via, and wherein, furthermore, at least some of the electrical connections has at least one meander.

Thanks to the invention, it is possible to increase dephasing between interconnected metal vias, without increasing the size of the conductive elements of the metamaterial structure by cleverly utilizing, using one or more meanders on at least some of the electrical connections between vias, the surface situated under the ground plane. Yet, it has been observed, surprisingly, that whereas the fact of multiplying the number of metal vias per conductive element does not enable, in itself, to reduce the overall size of an electromagnetically reflective plate, the fact of doing it in combination with a dephasing increase using one or more meander connection(s), enables such as size reduction.

Optionally, each electrical connection for connecting a metal via to another is etched on the lower face of the second dielectric substrate layer. Thus, the arrangement of the meanders is optimal.

Also, optionally, each one of said electrical connections has a plurality of meanders.

Also, optionally:

- the conductive elements are distributed into a matrix on the upper face of the first dielectric substrate layer, and
- each conductive element makes contact with four metal vias, each one of these four metal vias being connectable to another metal via of an adjacent conductive element in line or in column in the matrix.

This option is advantageous in the case where an axial symmetry along two orthogonal axes is desired to be obtained.

Also, optionally, the metal vias of each conductive element and the respective electrical connections thereof are distributed according to a central symmetry around a central symmetry axis of this conductive element.

Also, optionally, at least some of the electrical connections with meanders etched on the lower face of the second dielectric substrate layer is further equipped with adjustable dephasing devices.

Also, optionally, each electrical connection with meanders etched on the lower face of the second dielectric substrate layer progressively expands from the end thereof making contact with the corresponding metal via towards one of the edges of the conductive element under which it is etched.

Also, optionally, each one of the conductive elements has one of the shapes of the set consisting of a square shape, a rectangular shape, a spiral shape, a fork shape, a crutch cross shape and a dual crutch cross shape referred to as a UC-EBG shape.

Also, optionally, the conductive elements are periodically distributed over the upper face of the first dielectric substrate layer.

A miniature antenna device is also proposed, including:

- an electromagnetically reflective plate according to the invention, and
- an antenna, having an average functioning wavelength and placed at a distance from the reflective plate lower than one tenth of this average functioning wavelength.

Figure 2A:
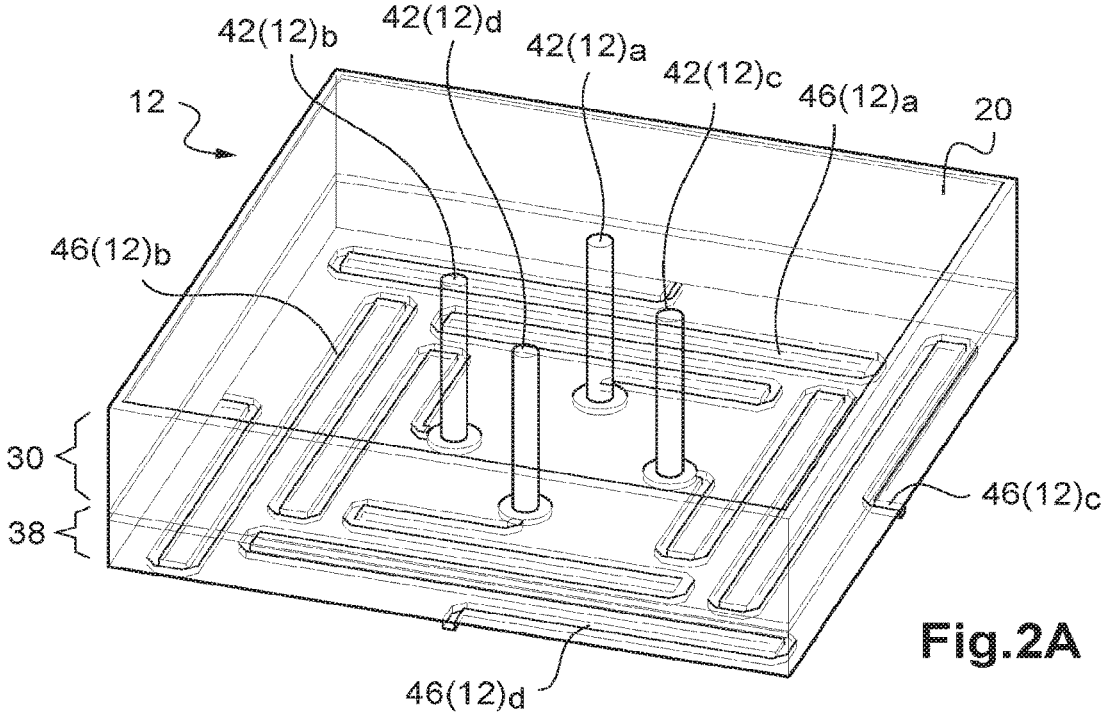
Figure 3A:
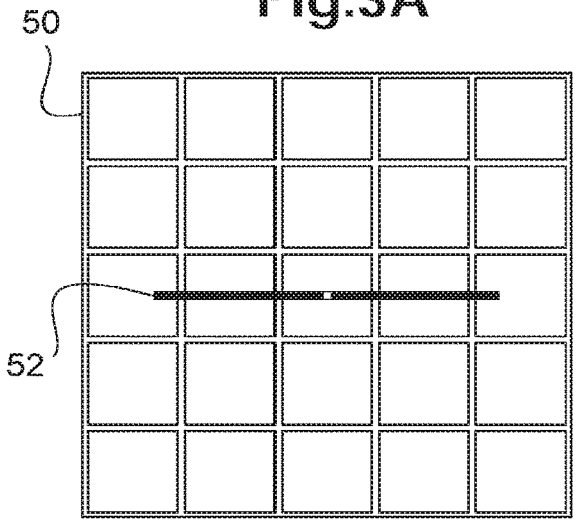
Figure 3B:
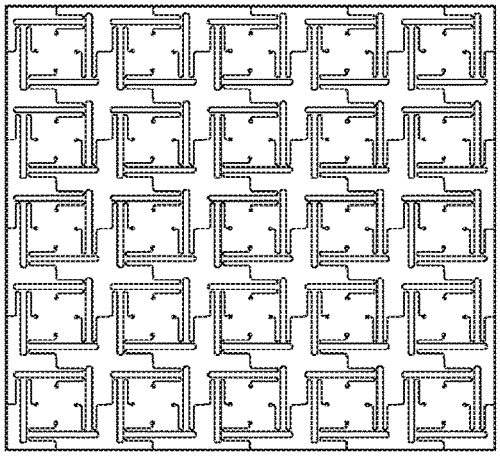
Figure 4:
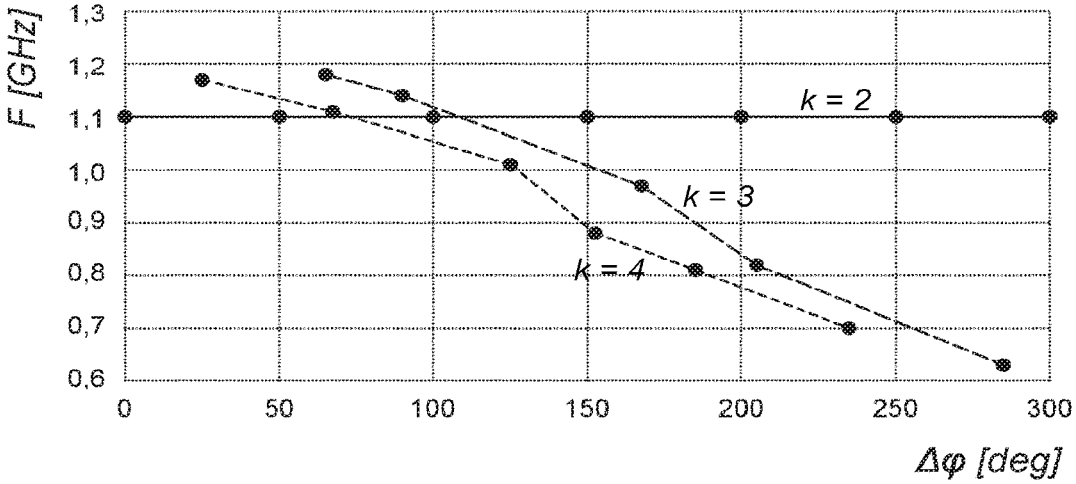
Figure 5:
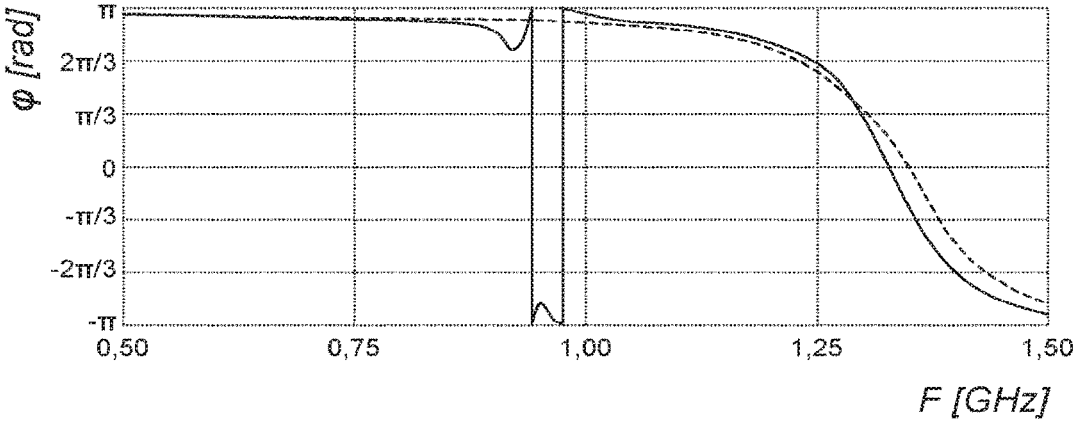

The invention will be better understood using the description which will follow, given only as an example and made in reference to the appended drawings, wherein:

FIG. 1 represent, in transparent perspective, the general structure of a portion of an electromagnetically reflective plate with a metamaterial structure for a miniature antenna device, according to an embodiment of the invention, FIG. 2A represents, according to a same transparent perspective, an elementary cell of the portion of plate in FIG. 1, FIGS. 2B, 2C and 2D are respectively front, top and bottom views of the elementary cell in FIG. 2A, FIGS. 3A and 3B illustrate, in top and bottom views, an example of an embodiment of a miniature antenna device including an electromagnetically reflective plate with a metamaterial structure, according to an embodiment of the invention, FIG. 4 is a diagram illustrating a relationship between the functioning frequency of an antenna device such as that in FIGS. 3A, 3B and some configuration parameters specific to the invention, and FIG. 5 is a diagram comparing phases of reflective coefficients as a function of functioning frequencies for a device according to the invention and a device of the state of the art.

The portion of electromagnetically reflective plate 10 with a metamaterial structure schematically represented in transparent perspective in FIG. 1 can be considered as composed of a plurality of elementary cells being repeated along two main directions x and y. In the example in this figure, to make it simple, only four elementary cells 12, 14, 16 and 18 are illustrated, one of which, for example cell 12, is represented by itself in FIG. 2A.

According to an overall description by layers along a direction z perpendicular to the directions x and y of the portion of plate 10, a plurality of conductive elements 20, 22, 24, 26 separated from each other are etched on an upper face 28 of a first dielectric substrate layer 30. These conductive elements are, for example, rectangular or square, but could be of any shape already studied in the state of the art. In particular, they could be a spiral shape, a fork shape, a crutch cross shape, or dual crutch cross shape, referred to as UC-EBG shape. Also, in particular, they could have interdigital capacities of spiral inductances, known to enable a certain miniaturization of the reflective plate as specified above. They are also, for example, distributed into a matrix by periodic repetition of the shape thereof along the directions x and y over the upper face 28 of the first dielectric substrate layer 30. In a variant, the conductive elements could be of different shapes for a non-uniform distribution over the upper face 28, for example, of increasing surfaces when it is expanded from a center, or any other relevant topology for a person skilled in the art according to the context of application.

The portion of plate 10 further includes a ground plane 32 placed between a lower face 34 of the first dielectric substrate layer 30 and an upper face 36 of a second dielectric substrate layer 38, with apertures 40 arranged in this ground plane 32.

Moreover, metal through-vias 42 are formed in the thickness of the first and second substrate layers 30, 38, each one including an upper end making contact with one of the conductive elements 20, 22, 24, 26, and a lower end reaching a lower face 44 of the second dielectric substrate layer 38. Each one of the vias 42 passes through the ground plane 32 without electrical contact in one of its apertures 40.

More specifically, in the non-limitative example in FIG. 1, each conductive element 20, 22, 24 or 26 makes electrical contact with four vias 42. In addition, under the invention, each via 42 of each conductive element 20, 22, 24 or 26 is connectable to another via of a neighboring conductive element, using a corresponding electrical connection 46 etched on the lower face 44 of the second dielectric substrate layer 38 and makes contact with the lower end of this via 42. Also, under the invention, so as to increase dephasing between any two vias interconnected by the lower ends thereof, at least some of the electrical connections 46 etched on the lower face 44 of the second dielectric substrate layer 38 has one or more meanders to optimize the occupation of this lower face 44. In the non-limitative example in FIG. 1, each one of these electrical connections 46 comprises one or more meanders.

The elementary cell 12, represented by itself in transparent perspective in FIG. 2A and in front, top and bottom views in FIGS. 2B, 2C and 2D, is formed from the conductive element 20 and from any substrate thickness situated below in the direction z. It is, for example, square with sides of length P. The conductive element 20 is also square with sides of length W, slightly less than P such that two conductive elements of two adjacent elementary cells do not touch each other.

Four vias 42 make contact with the conductive element 20 by the upper ends thereof. They are more specifically referenced 42(12)$_a$, 42(12)$_b$, 42(12)$_c$ and 42(12)$_d$ in FIGS. 2A to 2D. They are off-center with respect to the center of symmetry of the conductive element 20 but remain on the symmetry axes thereof. More specifically, the two vias 42(12)$_a$ and 42(12)$_d$ are on the symmetry axis of direction x of the conductive element 20 but off-center with respect to the center of symmetry thereof. Also, more specifically, the two vias 42(12)$_b$ and 42(12)$_c$ are on the symmetry axis of direction y of the conductive element 20 but off-center with respect to the center of symmetry thereof. d is referenced as the common distance between each via and the closest corresponding edge of the elementary cell 12.

Four electrical connections with meanders 46 are etched on the lower face 44 of the second dielectric substrate layer 38 in the elementary cell 12. They are more specifically referenced 46(12)$_a$, 46(12)$_b$, 46(12)$_c$ and 46(12)$_d$ in FIGS. 2A to 2D and correspond respectively to the vias 42(12)$_a$, 42(12)$_b$, 42(12)$_c$ and 42(12)$_d$ by making respective contact with the lower ends thereof. The electrical connection with meanders 46(12)$_a$ includes four meanders that are visible in FIG. 2D and progressively expands from the end thereof making contact with the corresponding metal via 42(12)$_a$ towards one of the edges of the elementary cell 12. It thus has a length that is greater than the distance which separates the via 42(12)$_a$ from this edge and enables the electrical connection thereof with another via of an adjacent conductive element (not represented in FIG. 1) in the negative direction of the direction x. The electrical connection with meanders 46(12)$_b$ includes four meanders that are visible in FIG. 2D and progressively expands from the end thereof making contact with the corresponding metal via 42(12)$_b$ towards another of the edges of the elementary cell 12. It thus has a length that is greater than the distance which separates the via 42(12)$_b$ from this edge and enables the electrical connection thereof with another via of an adjacent conductive element (not represented in FIG. 1) in the negative direction of the direction y. The electrical connection with meanders 46(12)$_c$ includes four meanders that are visible in FIG. 2D and progressively expands from the end thereof making contact with the corresponding metal via 42(12)$_c$ towards another of the edges of the elementary cell 12. It thus has a length that is greater than the distance which separates the via 42(12)$_c$ from this edge and enables the electrical connection thereof with another via of the adjacent conductive element in the positive direction of the direction y, in other words, the via 42(14)$_b$ of the elementary cell 14. Finally, the electrical connection with meanders 46(12)$_d$ includes four meanders that are visible in FIG. 2D and progressively expands from the end thereof making contact with the corresponding metal via 42(12)$_d$ towards another of the edges of the elementary cell 12. It thus has a length that is greater than the distance which separates the via 42(12)$_d$ from this edge and enables the electrical connection thereof with another via of the adjacent conductive element in the positive direction of the direction x, in other words, the via 42(16)$_a$ of the elementary cell 16.

It is noted that the four vias 42(12)$_a$, 42(12)$_b$, 42(12)$_c$ and 42(12)$_d$ of the conductive element 20 and the electrical connections with respective meanders 46(12)$_a$, 46(12)$_b$, 46(12)$_c$ and 46(12)$_d$ thereof are distributed according to a central symmetry around the center of symmetry of this conductive element 20. In addition, the surface of the lower face 44 of the second dielectric substrate layer 38 is broadly occupied by the respective electrical connections with meanders 46(12)$_a$, 46(12)$_b$, 46(12)$_c$ and 46(12)$_d$ between the vias 42(12)$_a$, 42(12)$_b$, 42(12)$_c$, 42(12)$_d$ and the four edges of the elementary cell 12.

Such a metamaterial structure defined in reference to FIGS. 1, 2A, 2B, 2C and 2D can advantageously be used for designing a miniature antenna device such as that represented in top and bottom views in FIGS. 3A and 3B.

This device includes a reflective plate 50 with a metamaterial structure composed of 25 elementary cells such as that illustrated in FIG. 2A, distributed into a matrix of 5 lines and 5 columns. It further includes a dipole antenna 52, visible in top view in FIG. 3A, placed at a distance from the reflective plate 50. More specifically, if this dipole antenna 52 has an average functioning wavelength referenced A, it can be placed at a distance from the reflective plate 50 less than one tenth of this average functioning wavelength, even at a distance close to λ/20, since the reflective plate 50 can behave like an artificial magnetic conductor when it is sized to reflect waves with a zero dephasing at the average functioning frequency of the antenna.

FIG. 3B illustrates, in bottom view, the interconnecting network of the vias using connections with meanders defined above. It is shown, that for a dipole antenna 52 of length 149 mm and of width 3.5 mm placed at a distance λ/20 from the reflective plate 50, an antenna device is obtained, with total dimensions 0.63.λ×0.63.λ×0.071.λ, where 0.071.λ is the thickness, in other words, an antenna device with a low profile, since the total thickness thereof is less than λ/10.

In a variant of an embodiment, at least some of the connections with meanders etched on the lower face 44 can be equipped with adjustable dephasing devices, known to a person skilled in the art, for example diodes, for interconnecting the conductive elements to each other. This enables to adjust dephasing according to the application to be optimized by simply varying the performance of the active or passive elements used, while preserving the metamaterial structure 10 or 50 and without the need to modify the length of the connections with meanders.

In compliancy with the invention and as illustrated in FIG. 4, a miniaturization of the elementary cells can be obtained by optimally adjusting the position of the four vias of each elementary cell and the dephasing Δφ between interconnected vias, this dephasing Δφ being adjusted by the length of the connections with meanders. Let us note k the parameter equal to P/d. This parameter k is necessarily strictly greater than 2 to be able to have four offset vias. At the limit, the presence of one single centered via gives k=2. The three curves in FIG. 4 are: the solid line curve for k=2, the long-dashed line curve for k=3 and the short-dashed line curve for k=4. It is noted, through experimentation, that the more the vias are centered, therefore the farther the edges of the elementary cell 12 are, k decreasing moving towards 2, the more the functioning frequency with reflection at zero dephasing, referenced F, decreases. Yet, the functioning frequency is inversely proportional to the antenna size. Therefore, at a given functioning frequency and antenna size, the vias getting closer towards the center leads to a miniaturization of the elementary cells. It is also noted, through experimentation, that under this configuration of elementary cells with a plurality of vias, the more dephasing Δφ and therefore the lengths of connections with meanders increase, the more the functioning frequency with reflection at zero dephasing decreases, which also leads to a miniaturization of the elementary cells. But, it is also noted, that the more vias are close to the center, the less significant the effect of dephasing Δφ on the functioning frequency is. At the limit, for k=2, there is no effect from increasing dephasing Δφ on the functioning frequency, as the horizontal solid line from the diagram in FIG. 4 shows. There is therefore a compromise to be found between the distance d of the vias with respect to the edges of each elementary cell and the implementable dephasings Δφ which are directly linked to the possible volume of the connections with meanders on the lower face 44 of the second dielectric substrate layer 38. This search for an optimal compromise depends on the application aimed for and is within the scope of a person skilled in the art.

The results in FIG. 4 have been obtained by varying the parameters k and Δφ using established simulations based on the miniature antenna device in FIGS. 3A and 3B with the following parameters:

P=53 mm,
W=51 mm,
thickness of the first dielectric substrate layer 30=5 mm,
thickness of the second dielectric substrate layer 38=1.6 mm,
relative permittivity of the dielectric substrate=4.4,
dielectric losses=0.02.

FIG. 5 is a diagram comparing phases of reflective coefficients according to the functioning frequencies for a miniature antenna device according to the invention (as a solid line) and a miniature antenna device of the state of the art with the same dimensions (as a short-dashed line). The device of the state of the art chosen has a mushroom-type reflective plate, in other words, with square conductive elements connected to a solid ground plane, each one using one single via (without a second substrate layer).

More specifically, for this comparison, the following parameters have been applied:

P=42 mm,
W=40 mm,
thickness of the first dielectric substrate layer 30=5 mm,
thickness of the second dielectric substrate layer 38=1.6 mm (for the device according to the invention only),
relative permittivity of the dielectric substrate=4.4,
dielectric losses=0.02,
radius of the vias=0.5 mm,
k=4 (for the device according to the invention only),
Δφ=186° (for the device according to the invention only).

The curves in FIG. 5 have been obtained by 3D electromagnetic simulation. Whereas the dotted curve obtained with the miniature antenna device of the state of the art has a passage to zero dephasing at around 1.35 GHz, that as a solid line obtained with the miniature antenna device according to the invention not only has a passage to zero dephasing slightly beyond 1.35 GHz, but particularly an inflection point at 940 MHz. Yet, the experiment shows that the presence of this inflection point enables to use the reflective plate of the miniature antenna device according to the invention as an artificial magnetic conductor at 940 MHz instead of 1.35 GHz. To use a mushroom-type reflective plate device as an artificial magnetic conductor at 940 MHz, P=64 mm should be applied, to have a passage to zero dephasing of around 940 MHz.

Thus, a gain in miniaturization of around 35% per dimension is thus highlighted, which makes a gain of more than 57% on the surface. Yet, comparisons on other properties such as antenna adaptation and radiation efficiency at a chosen functioning frequency, or directivity, show that miniature antenna devices according to the invention and with a mushroom reflective plate have absolutely compatible performances in terms of improvement with respect to reflective plane devices of the type approximating the perfect electrical conductor model. The gain in miniaturization is therefore all the more significant.

It clearly appears that an electromagnetically reflective plate with a metamaterial structure such as that defined above enables to miniaturize an antenna device including it, without having the disadvantages of cost, substantial reduction of the bandwidth of the antenna or substantial thickness volume. Only the available surface under the ground plane is utilized to obtain the advantageous technical effects resulting from the connections with meanders.

It will be noted, moreover, that the invention is not limited to the embodiments defined above.

In particular, although a miniature dipole antenna device has been detailed before, the invention is applicable to an antenna device, of which the antenna is of the ZOR type (Zeroth-Order Resonator), wire-plate, broadband, circular polarization or otherwise, placed parallel or perpendicularly to the reflective plane.

Also, in a variant, each conductive element of the metamaterial can make electrical contact with a number of vias that is different from four: for example, two, six, etc. The vias are not necessarily all identical, either.

Also, in a variant, the invention is also applied to a reflective plate with a metamaterial structure, of which the conductive elements are distributed over a plurality of layers, staggered or not.

Also, in a variant, the electrical connections between vias can be not all identical. It is particularly possible to vary the values of k and $\Delta\varphi$ from one elementary cell to the other.

Also, in a variant, the electrical connections between vias can be etched on a plurality of layers, not only on the lower face of the second dielectric substrate layer.

Also, in a variant, each conductive element of the metamaterial can make electrical contact with vias and/or corresponding electrical connections which are not distributed according to a central and/or axial symmetry with respect to the center and/or to one or more symmetry axes of the conductive element.

It will appear more generally to a person skilled in the art, that various modifications can be provided to the embodiments defined above, in light of the information which has just been disclosed to them. In the claims which follow, the terms used must not be interpreted as limiting the claims to the embodiments defined in the present description but must be interpreted to include all equivalents there that the claims aim to cover because of the formulation thereof and of which the expectation is within the scope of a person skilled in the art, by applying their general knowledge to the implementation of the information which has just been disclosed to them.

The invention claimed is:

1. An electromagnetically reflective plate with a metamaterial structure for a miniature antenna device, comprising:

a plurality of conductive elements separated from each other and etched on an upper face of a first dielectric substrate layer, each conductive element corresponding to a separate cell which includes the respective conductive element and a region underneath the conductive element;

a ground plane placed between a lower face of the first dielectric substrate layer and an upper face of a second dielectric substrate layer, with apertures arranged in the ground plane;

a set of metal through-vias formed in the thickness of the first and second substrate layers, each one including an upper end making contact with one of the conductive elements, a lower end reaching a lower face of the second dielectric substrate layer, and passing through the ground plane without electrical contact in one of its apertures;

wherein:

each conductive element makes contact with a plurality of metal vias within the respective cell of the respective conductive element, at least one metal via of at least one of the respective cells is connectable to another metal via of a neighboring cell, using a corresponding electrical connection making contact with the lower end of this respective metal via, and the corresponding electrical connection includes at least one meander etched on the lower face of the second dielectric substrate which connects with the another metal via of the neighboring cell by contacting another meander connected to the another metal via of the neighboring cell.

2. The electromagnetically reflective plate as claimed in claim 1, wherein each electrical connection for connecting a metal via to another is etched on the lower face of the second dielectric substrate layer.

3. The electromagnetically reflective plate as claimed in claim 1, wherein each separate cell includes a plurality of meanders.

4. The electromagnetically reflective plate as claimed in claim 1, wherein:

the separate cells are distributed in a matrix on the upper face of the first dielectric substrate layer, and each conductive element makes contact with four metal vias, each one of the four metal vias being connectable to another metal via of an adjacent cell in a line or in a column in the matrix.

5. The electromagnetically reflective plate as claimed in claim 1, wherein the metal vias of each separate cell and the respective electrical connections thereof are distributed according to a central symmetry around a central symmetry axis of this respective cell.

6. The electromagnetically reflective plate as claimed in claim 1, wherein at least some of the electrical connections with meanders etched on the lower face of the second dielectric substrate layer further include adjustable dephasing devices.

7. An electromagnetically reflective plate with a metamaterial structure for a miniature antenna device, comprising:

a plurality of conductive elements separated from each other and etched on an upper face of a first dielectric substrate layer, each conductive element corresponding to a separate cell which includes the respective conductive element and a region underneath the conductive element;

a ground plane placed between a lower face of the first dielectric substrate layer and an upper face of a second dielectric substrate layer, with apertures arranged in the ground plane;

a set of metal through-vias formed in the thickness of the first and second substrate layers, each one including an upper end making contact with one of the conductive elements, a lower end reaching a lower face of the second dielectric substrate layer, and passing through the ground plane without electrical contact in one of its apertures;

wherein:

each conductive element makes contact with a plurality of metal vias within the respective cell of the respective conductive element, at least one metal via of at least one of the respective cells is connectable to another metal via of a neighboring cell, using a corresponding electrical connection making contact with the lower end of this respective metal via, and the corresponding electrical connection includes at least one meander etched on the lower face of the second dielectric substrate which progressively expands from the lower end thereof making a connection with the another metal via of the neighboring cell.

8. The electromagnetically reflective plate as claimed in claim 1, wherein each one of the conductive elements has one of shapes of the set consisting of a square shape, a rectangular shape, a spiral shape, a fork shape, a crutch cross shape, and a dual crutch cross shape as a UC-EBG shape.

9. The electromagnetically reflective plate as claimed in claim 1, wherein the conductive elements are periodically distributed over the upper face of the first dielectric substrate layer.

10. A miniature antenna device comprising:

an electromagnetically reflective plate as claimed in claim 1; and an antenna, having an average functioning wavelength and placed at a distance from the reflective plate less than one tenth of the average functioning wavelength.

11. An electromagnetically reflective plate with a metamaterial structure for a miniature antenna device, comprising:

a plurality of conductive elements separated from each other and etched on an upper face of a first dielectric substrate layer, each conductive element corresponding to a separate cell which includes the respective conductive element and a region underneath the conductive element;

a ground plane placed between a lower face of the first dielectric substrate layer and an upper face of a second dielectric substrate layer, with apertures arranged in the ground plane;

a set of metal through-vias formed in the thickness of the first and second substrate layers, each one including an upper end making contact with one of the conductive elements, a lower end reaching a lower face of the second dielectric substrate layer, and passing through the ground plane without electrical contact in one of its apertures;

wherein:

each conductive element makes contact with a plurality of metal vias within the respective cell of the respective conductive element, at least one metal via of at least one of the respective cells is connectable to another metal via of a neighboring cell, using a corresponding electrical connection making contact with the lower end of this respective metal via, and the corresponding electrical connection includes at least one meander etched on the lower face of the second dielectric substrate which forms at least a portion of a connection between the lower end of this respective metal via and the lower end of the another metal via of the neighboring cell.

* * * * *